US009242390B2

(12) United States Patent
Nicholson

(10) Patent No.: US 9,242,390 B2
(45) Date of Patent: Jan. 26, 2016

(54) POWERED CIRCULAR SAW AND METHOD OF USE THEREOF

(71) Applicants: 7RDD Limited, York (GB); Ningbo Gemay Industry Co. Ltd., Ningbo (CN)

(72) Inventor: Marcus Nicholson, Manchester (GB)

(73) Assignees: 7RDD Limited, North Yorkshire (GB); Ningbo Gemay Industry Co., Ltd., Ningbo (CN)

( * ) Notice: Subject to any disclaimer, the term of this patent is extended or adjusted under 35 U.S.C. 154(b) by 296 days.

(21) Appl. No.: 13/962,134

(22) Filed: Aug. 8, 2013

(65) Prior Publication Data

US 2013/0318801 A1 Dec. 5, 2013

Related U.S. Application Data

(63) Continuation of application No. PCT/GB2012/050282, filed on Feb. 9, 2012.

(30) Foreign Application Priority Data

Feb. 10, 2011 (GB) ..... 1102368.6

(51) Int. Cl.
*B27B 9/02* (2006.01)
*B27G 19/04* (2006.01)

(52) U.S. Cl.
CPC .. *B27B 9/02* (2013.01); *B27G 19/04* (2013.01)

(58) Field of Classification Search
CPC ..... B27B 9/02; B27G 19/04
See application file for complete search history.

(56) References Cited

U.S. PATENT DOCUMENTS 3,262,472 A * 7/1966 McCarty ..... B27B 9/02 30/295
4,221,051 A * 9/1980 Glass ..... B27B 9/02 30/377
4,856,394 A * 8/1989 Clowers ..... B23D 9/006 30/286
5,121,545 A * 6/1992 Nonaka ..... B27B 9/02 30/375
5,136,910 A * 8/1992 Kuhn ..... B23D 59/002 144/136.1
5,239,756 A * 8/1993 Matzo ..... B27B 9/00 30/371
5,570,511 A * 11/1996 Reich ..... B27B 9/02 30/376
5,758,425 A * 6/1998 Gallagher ..... B27B 9/02 30/376
6,375,557 B1 * 4/2002 Spangenberg ..... B23Q 11/0046 451/344
6,735,875 B1 * 5/2004 Eslambolchi ..... B23D 45/122 30/377
6,886,259 B2 * 5/2005 Kani ..... B27B 9/02 30/376
7,975,388 B2 * 7/2011 Fuchs ..... B27B 9/00 30/377
8,104,183 B2 * 1/2012 Nakamura ..... B27B 9/02 30/375
8,495,940 B2 * 7/2013 Abe ..... B23D 45/042 30/388
8,640,346 B2 * 2/2014 Allen ..... B27B 9/02 30/376
2005/0155231 A1 7/2005 Hartmann et al.

(Continued)

FOREIGN PATENT DOCUMENTS

EP 1 053 829 11/2000
EP 2 045 055 4/2009
WO WO 2011/104538 A1 * 9/2011

*Primary Examiner* — Hwei C Payer
(74) *Attorney, Agent, or Firm* — Woodard, Emhardt, Moriarty, McNett & Henry LLP

(57) ABSTRACT

A powered circular saw tool (2) includes a tool body (4), an attachment for allowing a circular saw blade (8) to be attached to the tool body (4) in use, and a base plate (6) for supporting the tool body (4) on a workpieee or surface in use, The tool body (4) is capable of undergoing pivotal movement relative to the base plate (6) to allow a circular saw blade (8) to be pivoted to a required depth of cut with respect to a workpiece in use. A selector allows selection of the different operational modes.

15 Claims, 13 Drawing Sheets

(56) References Cited

U.S. PATENT DOCUMENTS

Figure 1A:
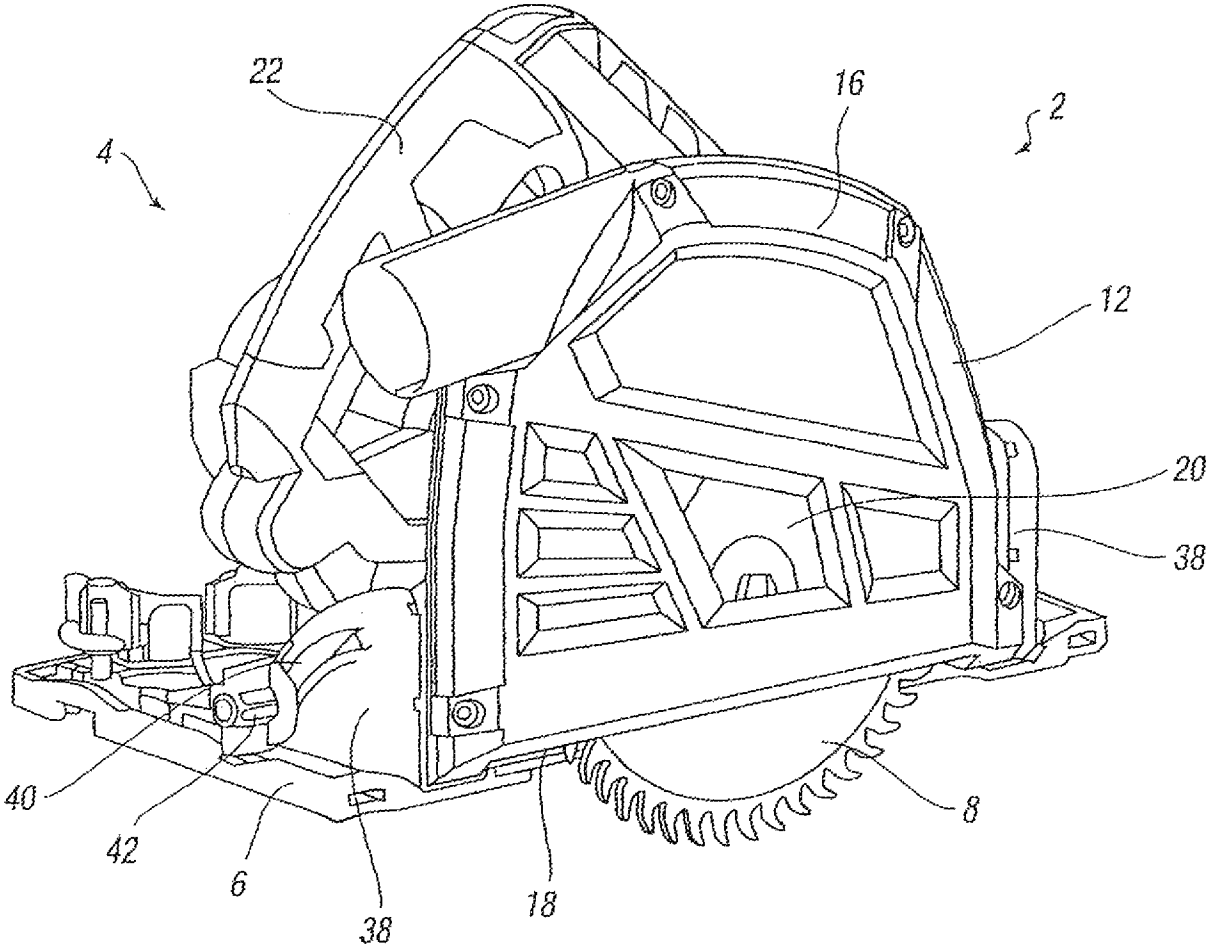

2008/0244910 A1* 10/2008 Patel ..... B23D 45/122 30/123
2009/0133559 A1* 5/2009 Sargeant ..... B27B 9/02 83/508.2
2010/0325903 A1* 12/2010 Patel ..... B23D 45/122 30/377
2011/0162218 A1* 7/2011 Roise ..... B27B 9/02 30/377
2013/0318801 A1* 12/2013 Nicholson ..... B27G 19/04 30/377

* cited by examiner

POWERED CIRCULAR SAW AND METHOD OF USE THEREOF

This invention relates to a powered circular saw and method of use thereof. The powered circular saw described herein is also often referred to as a plunge saw.

A powered circular saw, or plunge saw as they are also known, typically comprises a tool body or cutting head, a circular saw blade that is arranged to undergo circular motion with respect to the cutting head, a guard for covering the circular saw blade, an aperture defined in the guard for allowing at least a working part of the circular saw blade to protrude therethrough in use, a handle for allowing a user to grip the tool body, and a base associated with the tool body for allowing the tool to be placed directly in contact with a work piece or for location on a pre-defined track. A drive mechanism is typically provided in the tool body for driving rotational movement of the circular saw in use, and a power supply is provided, such as a battery pack, for providing power to the drive mechanism.

Circular plunge saws can typically pivot about two different pivotal axes in use; a first pivot axis about which the guard, the cutting bead and saw blade pivot relative to the base (suitable tor bevel cuts); and a second pivot axis about which the cutting head and saw blade pivot relative to the guard (suitable for plunge cuts). The two pivotal axes are typically perpendicular to each other. The degree of pivoting of the cutting head and saw blade about the second pivot axis typically determines the depth of cut of the saw blade in a workpiece in use.

Conventional powered circular saws typically comprise a number of operational or saw blade position modes which the tool can be moved between in use. The operational modes can include a "free plunge mode", wherein the circular saw blade and cutting he fid can Lie pivoted relative to the base to a required depth of cut, typically to about 55 mm; a "scribe mode" wherein the pivotal movement of the circular saw blade and cutting head relative to the base is limited to a pre-determined small distance, typically only about 3 mm, to allow an initial cut to be created in a workpiece; and a "blade change mode" wherein the circular saw blade and cutting head are locked in a pre-determined position relative to the base to allow the circular saw blade to be changed.

Conventionally, the mechanisms via which the tool can be switched between the different operational modes are independent and separate. However, a problem with these conventional, arrangements is that more than one operational mode can be selected by a user at any one time, thereby creating a potentially unsafe situation.

It is therefore an aim of the present invention to provide a powered circular saw or plunge saw tool that overcomes the abovementioned problems.

It is a further arm of the present invention to provide a method of using a powered circular saw or plunge saw tool that overcomes the abovementioned problems.

According to a first aspect of the present invention there is provided a powered circular saw tool, said tool including a tool body, attachment means for allowing a circular saw blade to be attached to the tool body in use, and a base plate associated with the tool body for supporting the tool body on a workpiece or surface in use, said tool body arranged such that it is capable of undergoing pivotal movement relative to said base plate to allow a circular saw blade to be pivoted to a required depth of cut with respect to a workpiece in use, said tool including two or more different operational modes that can be selected by a user in use, and wherein means for allowing selection of the different operational modes is the same for each different operational mode.

Thus, by providing single selection means for allowing selection of the different operational modes, only one of the two or more different operational modes can be selected at any one time, thereby making the tool safer to use.

Preferably the two or more different operational modes of the tool relate to different operational modes associated with the saw blade and can include any or any combination of a blade changing mode; a plunge mode; and a scribe mode. In the blade changing mode, the position of the tool body relative to the base plate is typically moved to a looked position to allow a circular saw blade to be fitted and/or removed, in the plunge mode, the tool body can be pivotally moved relative to the base plate to a required or user selected depth of cut. In a scribe mode, the range of pivotal movement of the tool body relative to the base plate is limited compared to that possible in the plunge mode.

Preferably guide means are provided to guide the movement of the tool body relative to the base plate in each of the different operational modes.

Preferably at least part of the mode selection means is movable with respect to said guide means in moving between said different operational modes.

In one embodiment one of the mode selection means and the guide means is in the form of at least one slot, recess, channel, aperture and/or the like and the other of the mode selection means and the guide means is in the form of at least one protrusion or pin for location in or movably mounted in said at least one slot, recess, channel, aperture and/or the like. The at least one protrusion or pin moves in the at least one slot, recess, channel or aperture to guide or determine the movement of the tool body with respect to the base plate and thus to determine the operational mode of the tool.

Preferably one of the slot, recess, channel, aperture and/or the like and the protrusion or pin is in the form of or shape of at least one arc or curve, such as an arc of a circle. The at least one arc typically corresponds to a path of movement the toed body takes relative to the base plate in each operational mode. The other of the slot, recess, channel, aperture and/or the like and the protrusion or pin locates with the at least one arc and follows the movement thereof in use.

Preferably the at least one are comprises two or more arcs, each arc corresponding to the or each of two or more different operational modes of the tool.

Preferably the at least one arc comprises at least three arcs, each arc corresponding to the or each of three different operational modes of the tool. Yet further preferably four arcs are provided that correspond to three different operational modes of the tool.

Preferably the two or more arcs are arranged substantially concentrically. The radius of the different arcs from a central point are typically different in length, thereby providing the arcs in a spaced apart arrangement.

In one embodiment two or more arcs are provided. Preferably the length of each arc (i.e. the distance from one end of the arc to an opposite end of the arc) is substantially different to allow the too), body to move through different distances with respect to the base plate in the or each of the different operational modes.

In one embodiment tree or more arcs are provided. Preferably the two or more arcs are a spaced distance apart from each other and each arc communicates with an adjacent arc via at least one joining portion. The joining portions allows the pin or recess to move between the different arcs.

Preferably the arc corresponding to a plunge mode is longer in length relative to the arc corresponding to die scribe mode. This provides the different degree of movement the tool body can take in the two different operational modes.

In one embodiment two or more arcs arc provided and preferably the arc corresponding to the blade change mode is the outer most arc. The position of this ate corresponds to the blade attachment means of the tool body becoming accessible to a user to allow changing of a blade. For example, an arbour bolt for attaching the blade to a tool body could be moved into a window of a saw blade guard through which the user can gain access.

In one embodiment at least part of the attachment means for the saw blade is slidably mounted in a slot, channel, aperture or recess defined in at least a portion of a guard provided for the saw blade. Preferably this slot, channel, aperture or recess is substantially concentric with the tool mode selection arcs. This allows movement of the mode selection means with respect to the mode selection arcs to follow similar movement of the saw blade or saw blade attachment means with respect to the guard and/or base plate.

In one embodiment the tool is provided with a guard tor the saw blade. The guard typically includes an inner guard portion adjacent the tool body and an outer guard portion opposite the inner guard portion. The saw blade is typically located between the inner and outer guard portions in use.

Preferably one of the guide means and mode selection means is provided on the inner guard portion and the other of the guide means and mode selection means is provided on or associated with the tool body.

In a preferred embodiment the guide means is in the form of one or more slots, recesses, channels, apertures and/or the like and the selection means for allowing selection of the different operational modes of the tool is in the form of a selection pin or protrusion.

In one embodiment the selection pin or protrusion is capable of undergoing rotational movement or movement through at least a partially circular path to allow movement, of the same between different arcs, recesses, channels, slots and/or apertures.

Preferably locking means are provided to lock the mode selection means into a particular selected operational mode in use.

Preferably the locking means includes a locking pin or protrusion that is positioned a spaced distance apart from said selection pin or protrusion on said tool, said locking pin or protrusion locking, the tool in s particular selected operational mode.

Preferably the locking pin or protrusion substantially follows the movement of the selection pin or protrusion in use. Further preferably the locking pin or protrusion is movable in the one or mote arcs and/or joining portions associated with the mode selection means.

Preferably the selection pin or protrusion is integral with, attached to or joined to a rot a table member or cylinder, rotation of the rotatable member or cylinder causing rotation of said selection pin or protrusion in use or movement of the selection pin or protrusion through at least a partially circular path in use. The rotational or circular movement allows the selection pin or protrusion to move between different selection mode arcs.

Preferably the locking pin is associated with the rotatable cylinder or member, such that movement of the rotatable cylinder or member and selection pin or protrusion causes corresponding movement of the locking pin or protrusion. Further preferably the selection pin or protrusion is provided within the cutter circumference of the rotatable cylinder or member and the locking pin or protrusion is provided externally of the outer circumference of the rotatable cylinder or member. In one example, rotation of the rotatable cylinder or member drives movement of the locking pin or protrusion in use. This movement allows the locking pin of protrusion to move between and/or along one or more arcs or joining portions.

Preferably the locking pin or protrusion and the mode selection pin or protrusion are arranged substantially concentrically of the rotatable cylinder or member. The locking pin or protrusion typically has a different length radius to that of the mode selection pin or protrusion.

Preferably user actuation means are associated with the rotatable cylinder or member or the mode selection means to above a user to select one of the plurality of different operational modes of the tool. Thus, in one embodiment a single user actuation means is provided for selection or the different operational modes.

In one embodiment biasing means ate associated with the locking pin, protrusion or locking means to bias the locking pin, protrusion or locking means to a locked position in use. User actuation means ate typically associated with the locking pin, protrusion or means to allow the locking pin, protrusion or means to move to an unlocked position in use. The locking pin typically has to be in an unlocked position tot the tool to be moved between the different operational modes.

Preferably the arcs and/or joining portions are in the form of channels or recesses and the depth of the channels or recesses in one or more parts of the arcs and/or joining portions are different to allow location of the locking pin therein. For example, one or more locking holes (i.e. a part of the channels or recesses with greater relative depth to the remainder of the channels or recesses) can be defined in the channels or recesses to allow the locking pin to be biased into the same to form a locked positron.

Preferably the tool, body includes any or any combination of drive means for driving rotation of the saw blade in use, the drive means can include a motor, suitable gearing, mechanical linkage and/or the like; power means for providing power to drive the drive means, the power means can include a cable for connection to a mains power supply, battery power, rechargeable battery power and/or the like; a blade guard for guarding a user from direct contact with the cutting edge of the blade; handle means for allowing a user to grip the tool body, control means for allowing a user to move the tool between an "on" condition and an "off" condition; pivotal actuation means tor ah owing a user to pivot a part of the tool with respect to the base plate about a suitable pivot axis; measurement means for allowing a depth of cut to be measured when the tool is in the plunge mode or scribe mode, measurement means for allowing a bevel angle to be measured when the tool is pivoted in a bevel mode and/or the like.

According to a second aspect of the present invention there is crowded a method of using a powered circular saw rood said tool including a tool body, attachment means for allowing a circular saw blade to be attached to the tool body in use, and a base plate associated with the tool body for supporting the tool body on a workpiece or surface in use, said tool body arranged such that it is capable of undergoing pivotal movement relative to said base plate to allow a circular saw blade to be pivoted to a required depth of cut with respect to a workpiece in use, said method including the step of selecting an operational, mode for the tool from two or more different selectable tool operational modes, and wherein a means for allowing the selection of the different operational modes is the same for each different operational mode.

According to an aspect of the present invention there is provided a powered circular saw tool, said tool including two or more different operational modes that can be selected by a user in use, characterised in that single user selection means are provided to allow a user to select said two or more different operational modes.

it is to be noted that the two or more different operational modes of the tool referred to herein typically relate to different operational or cutting modes or positions associated with the saw blade and are in addition to the power operational mode of the tool, such as an "on"/"off" switch for the tool.

Preferably the user moves the tool between the two or more different operational modes using user actuation means.

Preferably the two more different operational modes ate pre-determined positions that the tool can he located in use.

According to an aspect of the present invention there is provided a powered circular saw tool, said tool including two or more different operational modes that can be selected by a user in use, characterised in that said two or more different operational modes correspond to movement of mode selection means in two or mote different arcs, said two or more different arcs being substantially concentric but having different length radii.

According to one aspect of the present invention a track compensation mechanism is provided for a circular saw. This mechanism compensates for a measured depth of cut of the tool in a plunge mode depending on whether the tool is to be used on or off a track. The compensated distance is typically substantially equal to the thickness of the track.

Preferably the track compensation mechanism includes stop means that can be moved between a retracted position and an extended position. When the circular saw is not used on a track, the track compensation mechanism is moved to an extended position. When the circular saw is used on a track, the track compensation mechanism is moved to a retracted position.

With the stop means in an extended position, the tool body is prevented from moving a pre-determined distance, corresponding to the depth of a track, towards the base plate when in a plunge mode. The depth of cut selected by a user of the tool on measurement means to which the stop means are associated with corresponds to the actual depth of cut that can be made with the stop means in the extended position.

With the stop means in a retracted position, the tool body is able to move a user selected distance corresponding to a required depth of cut. The stop means does not limit the movement of the tool body with respect to the measurement means so the tool body is able to move a user selected distance corresponding to a required depth of cut.

According to further and independent aspects of the present invention there is provided an anti-kick back mechanism for preventing kick back of a circular saw when used on a track; a track lock mechanism tor locking a circular saw to a track; and a fine adjustment mechanism Par reducing play or unwanted movement between a circular saw when located on a track.

Figure 2:
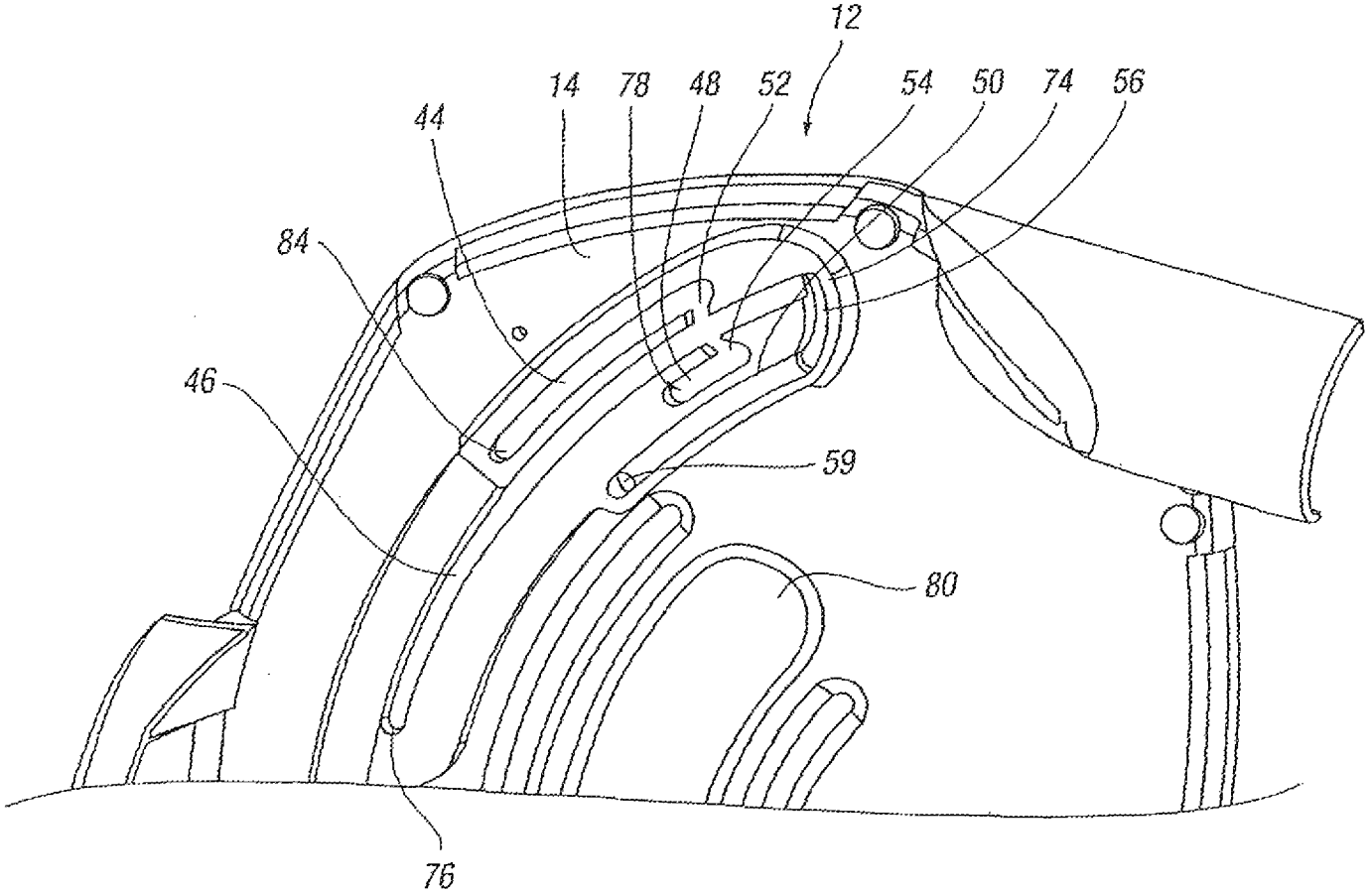
Figure 3A:
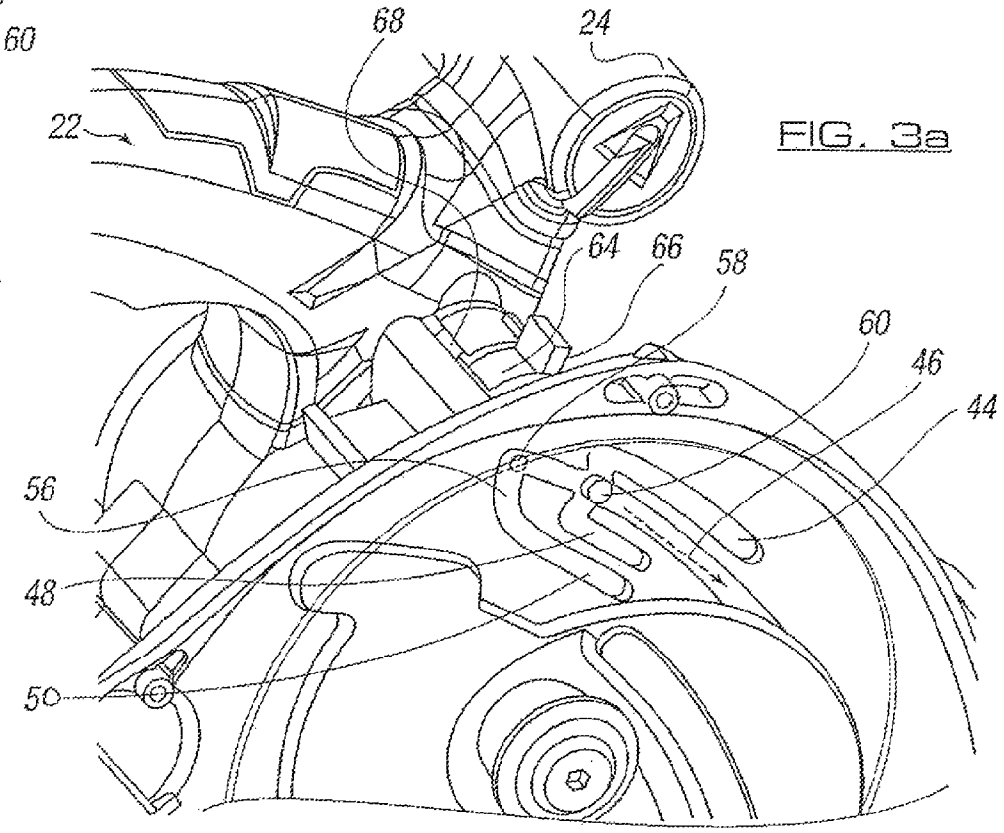
Figure 3B:
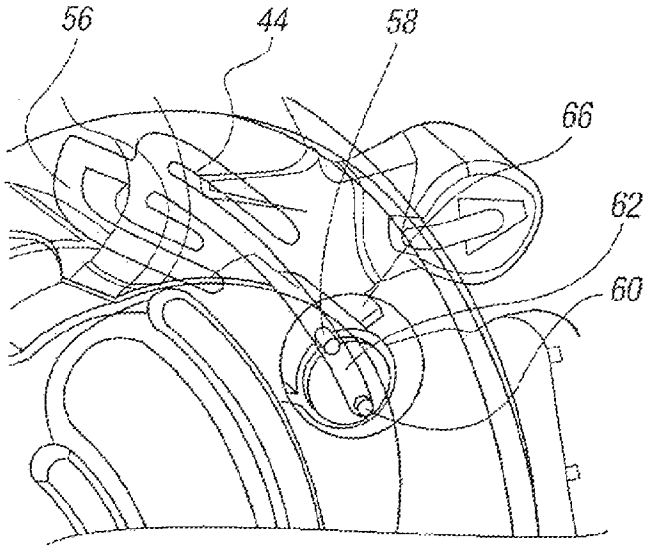
Figure 4B:
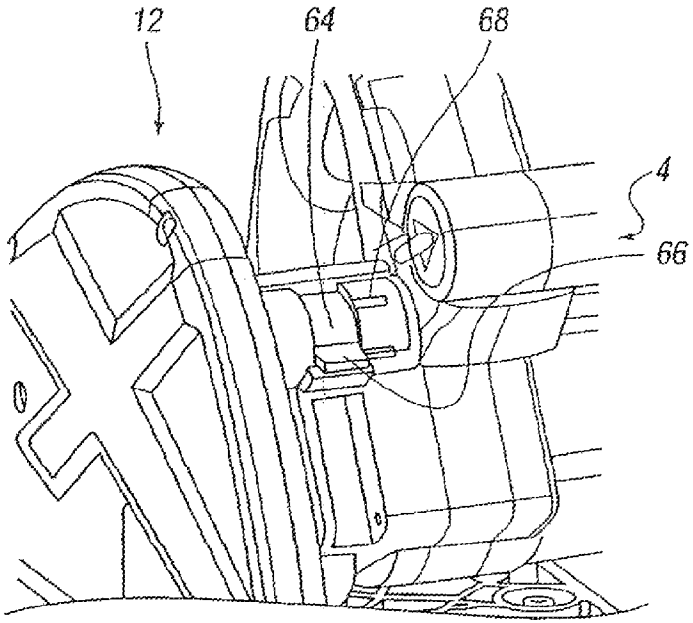
Figure 4A:
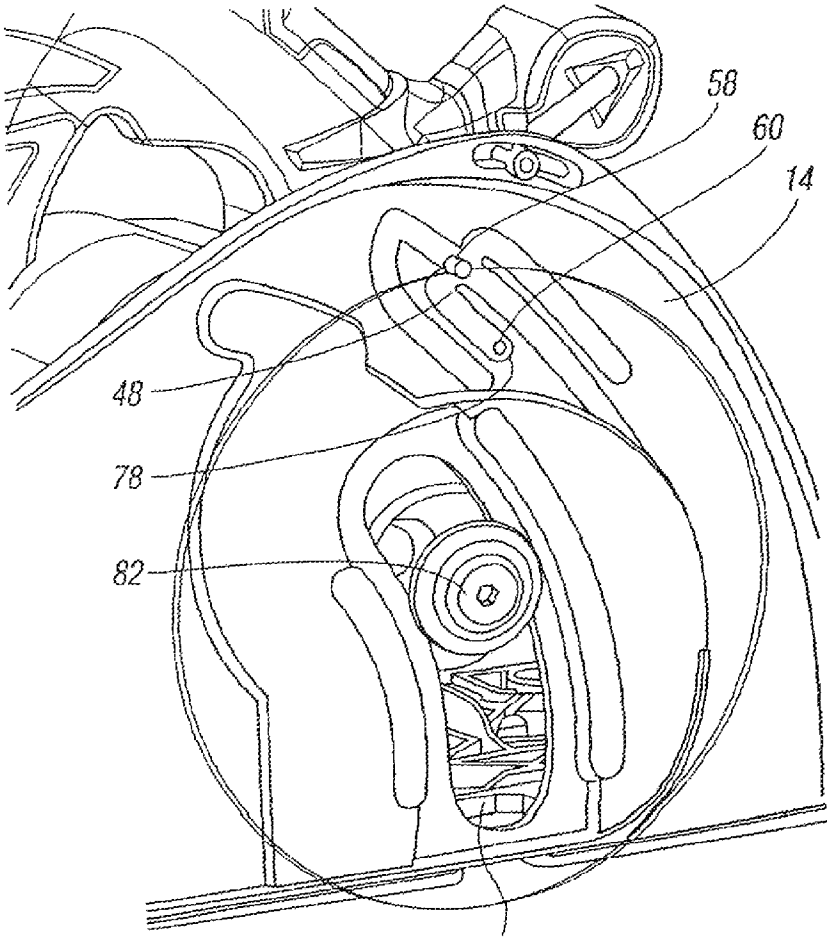
Figure 5B:
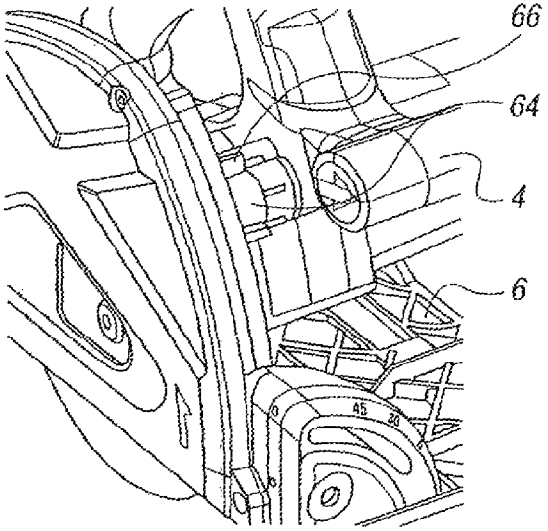
Figure 5C:
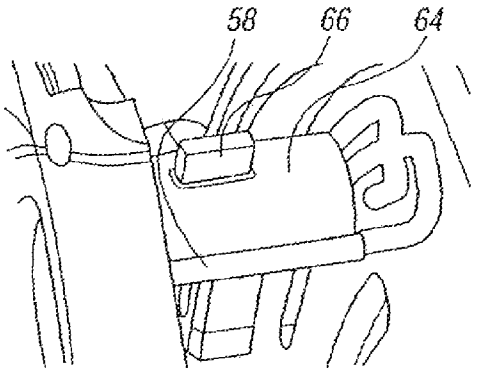
Figure 5A:
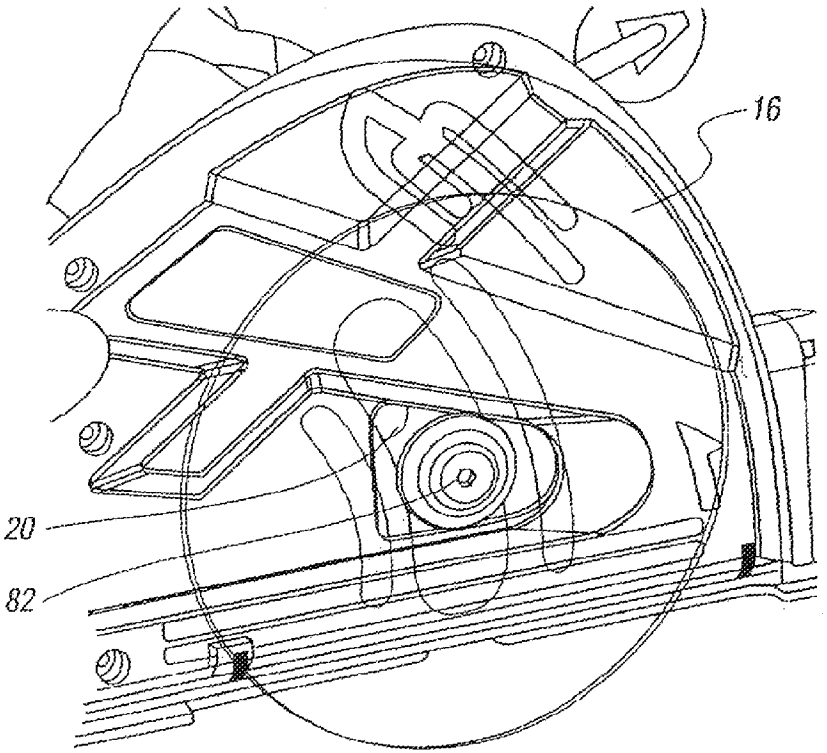
Figure 6:
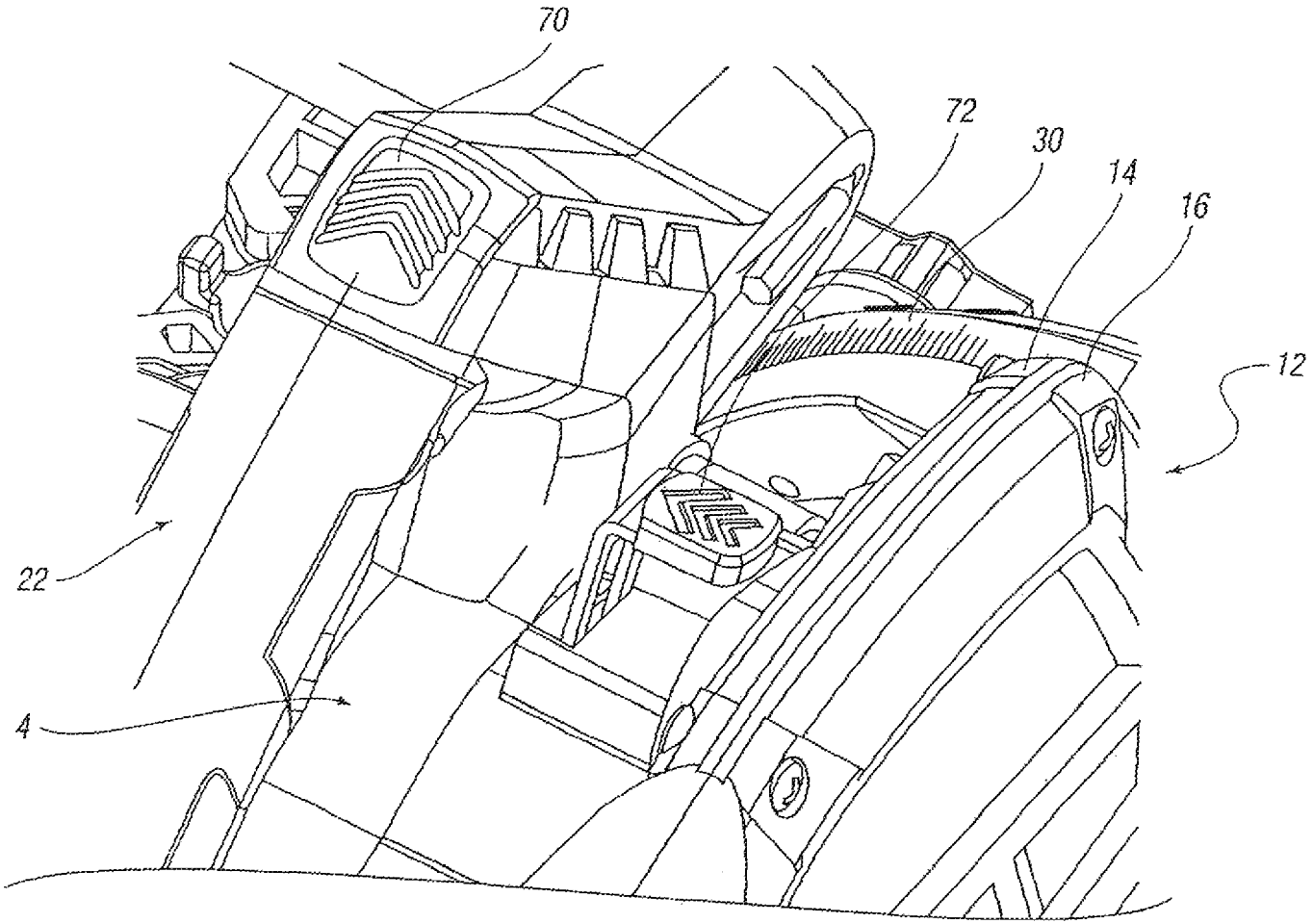
Figure 7B:
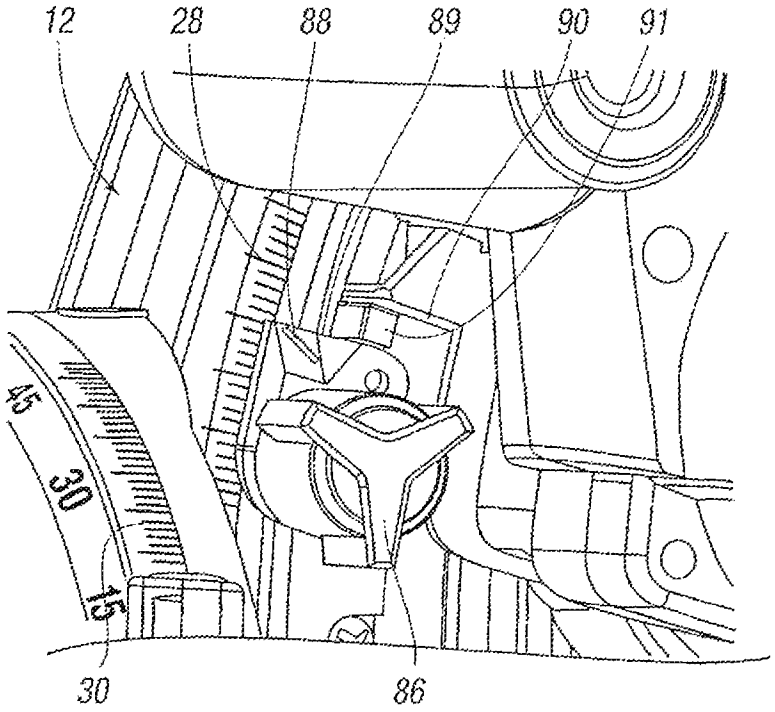
Figure 7A:
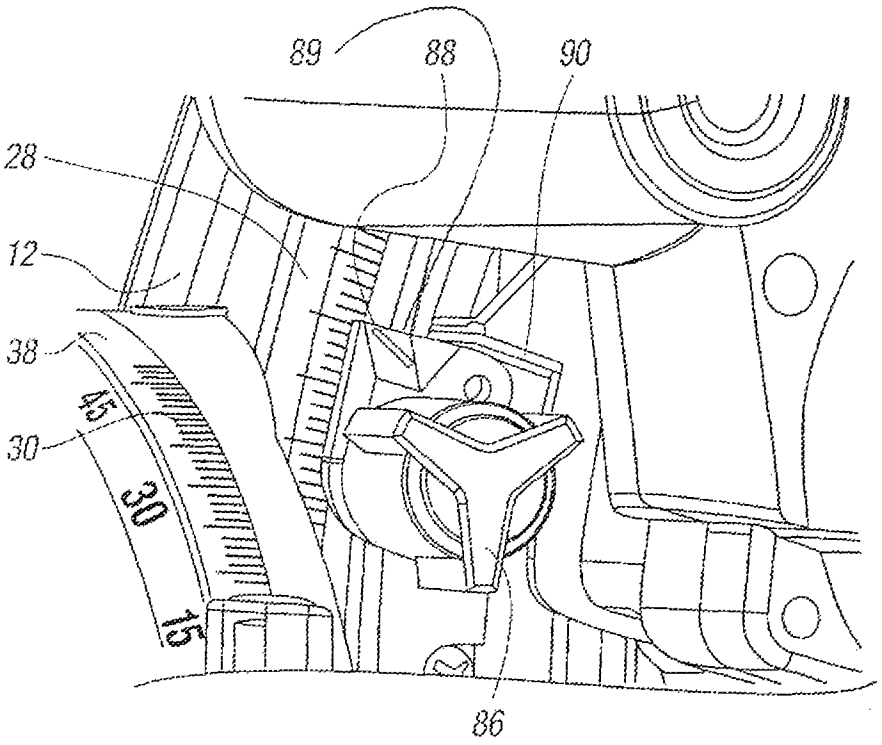
Figure 9B:
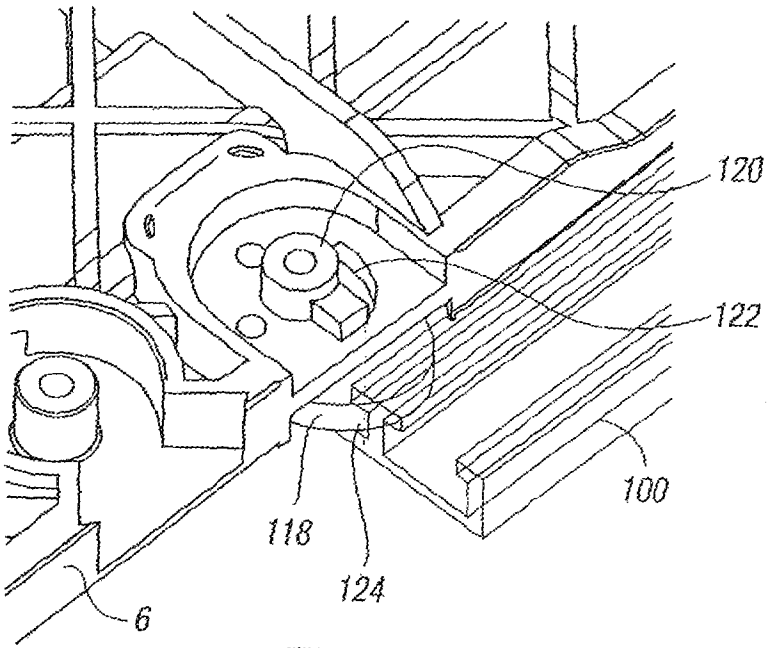
Figure 9C:
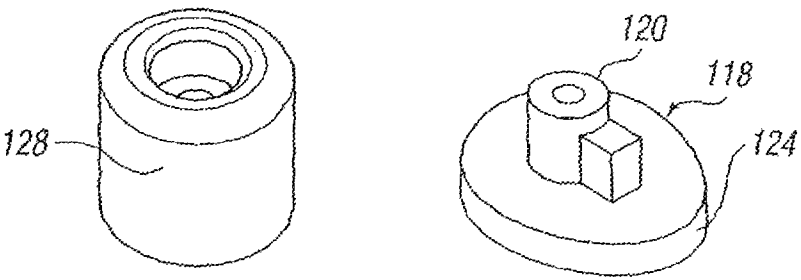
Figure 9A:
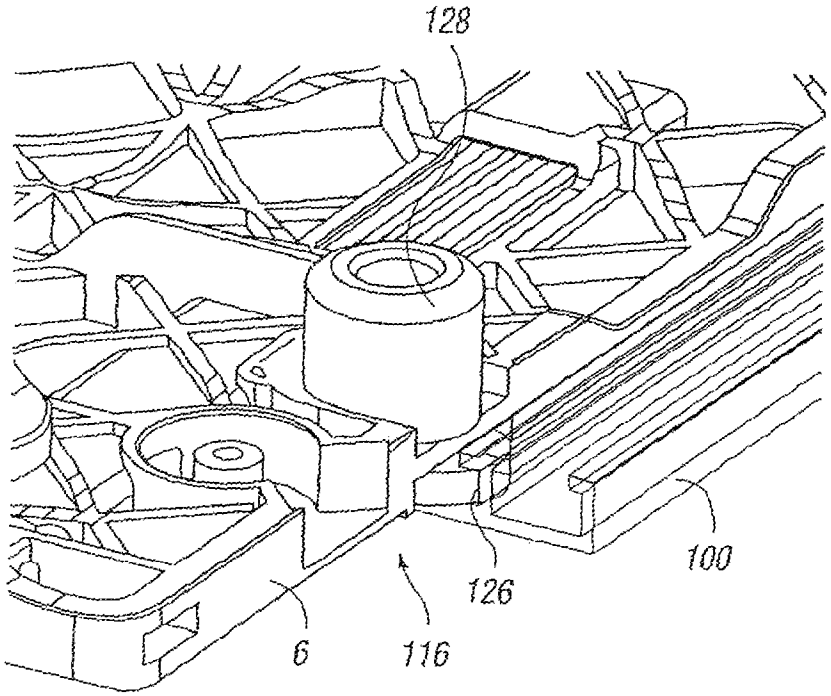

Embodiments of the present invention will now be described with reference to the following drawings, wherein:

FIGS. 1*a*-1*d* show a perspective view from a front side, a perspective view from a tear side, a rear side view showing a first pivot point, and a rear side view showing a second pivot point respectively of a circular plunge saw according to an embodiment of the present invention;

FIG. 2 is an enlarged view of an inner guard portion of the tool showing arc guide means to allow different operational modes of the tool to be selected;

FIGS. 3*a*-3*b* illustrate a partial view of a guard for the tool showing the mode selection pin and locking pin in a start position and an end position of the tool in a plunge mode respectively;

FIGS. 4*a*-4*b* illustrate a partial view of a guard for the tool showing the mode selection pin and locking pin in an end position when the tool is in a scribe mode, and a view from the side of the tool in the same mode respectively;

FIGS. 5*a*-5*c* illustrate a partial view of a guard for the tool showing the mode selection pin and locking pin in a blade change mode, a view from the side of the tool, and a partially exploded view from the side of the tool in the blade changing mode respectively;

FIG. 6 illustrates a partial view of the tool body from above showing a lock release lever;

FIGS. 7*a*-7*b* illustrate a track compensation mechanism in one embodiment of the present invention in an "out of use" position and in an "in use" position respectively;

FIGS. 8*a*-8*d* show a perspective detailed view of a fine adjustment mechanism from the rear when the base plate of the tool, is attached to a track in use; an exploded view of the fine adjustment mechanism; a side view from the front and a partial view of the fine adjustment mechanism respectively;

FIGS. 9*a*-9*c* illustrate a perspective view of a track lock in one embodiment of the present invention for locking the base plate of the tool to a track in use, a partial perspective view and an exploded view of the track lock respectively; and FIGS. 10*a*-10*d* illustrate a perspective view from above of an anti-kick back mechanism in one embodiment of the present invention to ensure the tool body only moves in one direction when the base plate is engaged on a track in use, a view from the base, an exploded view, and a partial view from above of the anti-kick back mechanism respectively.

Referring firstly to FIGS. 1*a*-1*d*, there is shown a powered circular plunge saw 2 including a tool body 4 and a base plate 6 for supporting the toot body on a workpiece of surface in use.

A circular saw blade 8 is attached to the tool body 4 and has suitable drive means in the form of a motor 10 located in the tool body for driving rotation of the saw blade in use. Power means in the form of a battery pack (not shown) forms part of the tool body 4 to provide power to the drive means.

A guard 12 is provided around a substantial part of the saw blade to prevent a user from cutting themselves on the blade and includes an inner guard portion 14 (facing the tool body) and an outer guard portion 16 (facing away from the toed body). A working aperture 18 is provided adjacent the base of guard 12 to allow a working part of the saw blade to protrude therethrough in use. A blade changing window 20 is provided on outer guard portion 16 to allow a user to change the saw blade when the tool is located in a blade changing mode (as described in more detail below).

The tool body 4 has a first handle portion 22 and a second handle portion 24 to allow a user to grip the tool body in use with both hands in a sate and controlled manner. A control switch 26 is provided on handle portion 22 to allow the tool to be moved between "on" and "off" conditions. First and second handle portions 22, 24 are typically provided at substantially 90 degrees to each other in this embodiment to provide an ergonomic arrangement of the user's hands for operating the tool.

The tool 2 has three operating modes; a plunge mode, wherein the saw blade can be moved to a required depth of cut selected, by the user (typically up to a. maximum of 55mm), a scribe mode, Wherein the saw blade can be moved to a more limited depth of cut (typically up to a maximum of 3mm); and a blade .change mode, wherein the tool body is moved to a position where the attachment for the saw blade is accessible to a. User to allow a blade to be changed.

A distance measurement ruler 28 is provided on inner guard portion 14 to allow the required depth of cut to be set tor when the tool is in the plunge mode. An angle measurement indication 30 is provided adjacent base plate 6 to allow a bevel angle to be measured and set. On both measurement indicators/ruler 28, 30, a bolt and locking screw 32 are typically provided to allow a required measurement to be set by the user in use.

Figure 1B:
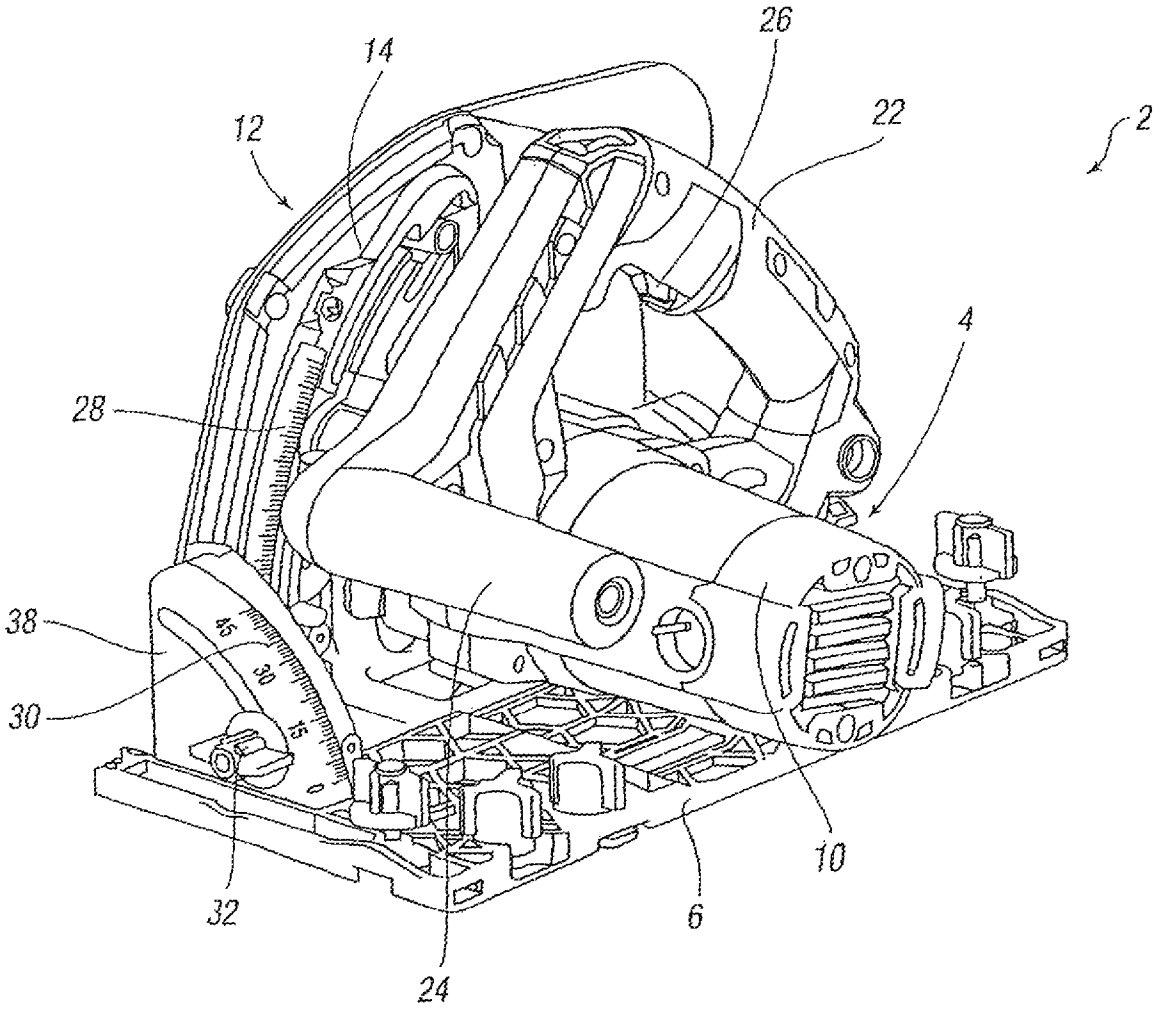
Figure 1C:
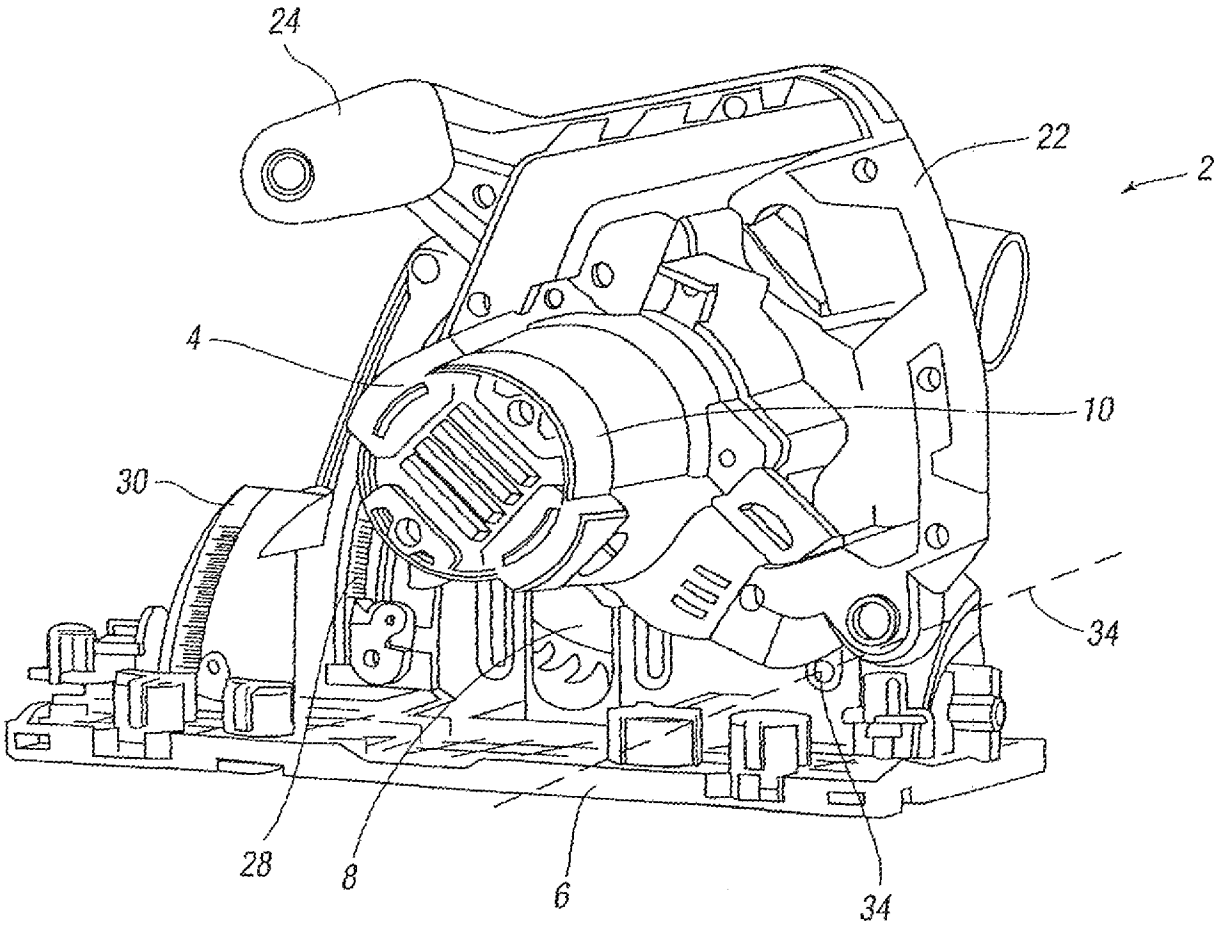

The tool body 4 and saw blade 8 are capable of being pivoted about a first pivotal axis 34 (a substantially horizontal axis) to allow the tool body to be moved between the blade changing mode, the scribe mode and the plunge mode. In pivoting tool body 4 to a cutting position, handle 24 is moved from a raised position, as shown in FIG. 1*c*, towards base plate 6, to a lowered position, as shown in FIG. 1*b*. The tool body has biasing means to bias the tool body to the raised position. Thus, the tool automatically moves back from a cutting position to a start or non-cutting position when a user removes their grip on handles 22, 24. This start or non-cutting position is also a locked and salt position, wherein locking means are engaged, as will be described in more detail below.

Figure 1D:
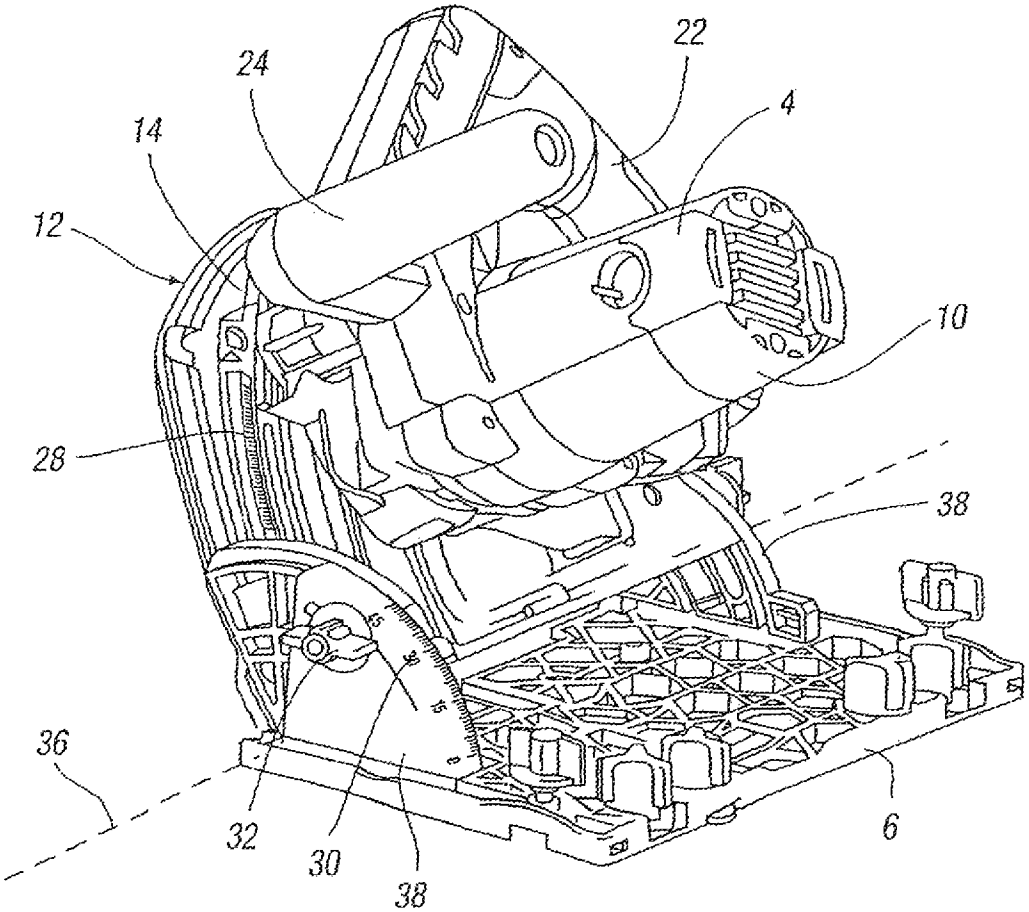

The tool body 4, saw blade 8 and guard 12 are capable of pivotal motion about a second pivotal axis 36 to allow bevel cuts to be made using the tool, as shown in FIG. 1*d*. Thus, the tool body and guard arc pivoted outwardly with respect to base plate 6. Second pivotal axis 36 is a substantially horizontal axis and is substantially perpendicular to first pivotal axis 34. In this embodiment, two upstanding support plates 38 are provided on base plate 6. Curved slots 40 are defined in said support plates 38 to guide the outwardly pivoting movement of the tool body 4 and guard 12 with respect to base plate 6. Bolt and locking nuts 32, 42 are provided to secure the required angle of the fool body relative to base plate 6.

In accordance with the present invention, the tool 2 is provided with mode selection means that allows a single mode selection means to select one of the three different operational modes (i.e. the plunge mode, blade change mode and scribe mode). This ensures that only one operational mode can be selected by a user at any one time.

Guide means in the form of four slots or channels 44, 46, 48, 50 are defined on inner guard portion 14, The channels 44-50 are in the form of arcs of a circle, they are substantially concentric, to each other and have different length radii from a shared central point (i.e. they are spaced distance apart). Each channel is joined to an adjacent channel by a joining portion 52, 54, 56. As such, a continuous path can he followed in moving between all four channels.

The outermost channel 44 is for the blade changing mode; the adjacent channel 46 is for the plunge mode (which is the longest arc); the next adjacent channel 48 (which is the shortest arc) is for the scribe mode; and the innermost channel is for location of a locking pin 58 when a mode selection pin is located in the blade changing arc, as will be described in more detail below.

The depths of the channels 44-50 and joining portions 52-56 are of substantially uniform depth, apart frame joining portion 56 and far end 59 of channel 50 where the depth of the same is deeper, as will be described in mote detail below.

The mode selection, means includes a mode selection pin 60 that is provided on an end 62 of a rotatable cylinder 64, which in turn is to ratably mounted on tool body 4. End 62 of cylinder 64 faces towards outer guard portion 16. Pin 60 is located within the outer circumference of the cylinder adjacent a circumferential edge thereof.

Mode selection pin 60 is slidably movable in channels 44-50 and joining portions 52-54. The tool body, and thus the saw blade, follows the movement of the selection pin 60 in said channels and joining portions. As such, the saw blade can be moved to required positions corresponding to the different operational modes on movement of the mode selection pin 60. Rotation of the rotatable cylinder 64 causes movement of mode selection pin 60 between the concentric arcs and between the curved joining portions 52-54. Pivotal movement of the tool body with respect to the base plate moves mode selection pin 60 along the length of the arcs.

User selection means in the form of a switch lever 66 extends outwardly from an outer surface of rotatable cylinder 64 to allow a user to select a required mode of operation. Mode indication markings 68 can be provided on the tool body to indicate to a user when a required mode of operation has been selected.

A locking pin 58 is associated with rotatable cylinder 64 such that locking pin 58 follows movement of the mode selection pin 60. More particularly, looking pin 58 is driven by movement of cylinder 64. The longitudinal axis of pin 58 is substantially parallel to the longitudinal axis of mode selection pin 60 and cylinder 64. Furthermore, the locking pin 58 is concentric with cylinder 64, as is mode selection pin 60. The locking pin 58 is resiliently biased towards outer guard portion 16 to allow a locked position to be provided. Thus, locking pin 58 can extend further towards enter guard portion 16 compared to mode selection pin 60. As such, when locking pin 58 is moved over an area of a channel 44-50 or joining portion 52-56 that has greater depth than the remaining area of the channel or joining portion, the locking pin 58 locates in the deeper region and forms a locked position. The tool body 4, saw blade 8 and mode selection pin 60 cannot then be moved further until the locking pin 58 is moved to an unlocked position.

With reference to FIG. 6, there is illustrated a lock release lever or button 70 on handle 22 that must he depressed by a user to move locking pin 58 against its biasing force and away from guard 12, from a locked position to an unlocked or release position. Button 70 is connected to locking pin 58 through a mechanism provided in the tool body, such that depression of lever 70 moves the locking pin 58 away from guard 12 and hack towards tool body 4, thereby moving the locking pin out of a deeper locking recess defined in channels 44-50 or joining portions 52-56.

A shaft lock lever 72 is provided on tool 2 to lock the shaft of the saw blade in place so chat the blade can be changed when the tool is in a blade changing mode.

With reference to FIGS. 3*a*-3*b*, there is illustrated a start and end position of mode selection pin 60 and locking pin 58 in the plunge mode respectively. The start position of the plunge mode is typically a default mode the tool body takes when resiliently biased to a non-cutting position. In this start position, the mode selection pin is located in channel 46 adjacent, joining portions 52 and 54. It is to be noted that the openings to joining portions 52, 54 are substantially opposite each other to allow the mode selection pin 60 to be easily moved into either portion from the default position. The locking pin 58 is a spaced distance apart behind pin 60 and is located at an end 74 of joining portion 56 and channel 46. The recess of joining portion 56 is deeper than channel 46 and so the tool body is locked in this position until a user moves locking button 70 to an unlocked position. A user is then able to move tool body 4 towards base plate 6, thereby sliding mode selection pin 60 along channel 46 to a required depth of cut. The maximum limit of the depth of cut is determined by the pin 60 engaging with the end 76 of channel 46. A user selected depth of the cut less than the maximum limit is set as a result of the user moving the position of pointer 88 provided on the distance measurement ruler 2*b* to a required depth of cut, and possibly utilising the track compensation mechanism, as is described in more detail below with reference to FIGS. 7*a*-7*b*. If a user releases their grip on the tool body, the tool body is resiliently biased back to a non-cutting position and the mode selection pin 60 and locking 58 move in reverse.

With reference to FIGS. 4*a*-4*b*, there is illustrated a position of mode selection pin 60 and locking pin 58 in the scribe mode. The mode selection lever 66 is first moved to the next indication marking 68 on the tool body corresponding to the scribe mode. The tool body is then pivotally moved relative to base plate b under control of the user. This allows mode selection pin 60 to be moved to end 78 of channel 48 and the locking pus 58 is moved to channel 46 at the opening of joining portions 52, 54. The depth of cut is limited by the length of channel 48, typically corresponding to a depth of cut of 3 mm, which is much shorter than the length of channel 46 used for the plunge mode, which typically corresponds to a maximum depth of cut of 55 mm.

FIG. 4*a* also shows how a curved or arc slot 80 defined in inner guard 14, which allows slidable movement of the saw blade attachment means therein in use, part of which is shown as an arbour bolt 82 in this embodiment, is concentric with arc channels 44-50. As such, the saw blade 8 and tool body 4 follow a similar motion to mode selection pin 60 in moving between the different operational modes.

With reference to FIGS. 5*a*-5*c*, there is illustrated a position of the mode selection pin 60 and locking pin 58 in the blade changing mode. The mode selection pin 60 is moved into outermost channel 44 and, in doing so, locking pin 58 is moved along joining portion 56 and into innermost channel 50. When mode selection pin 60 contacts, end 84 of channel 44, locking pin 58 engages in the deeper recess provided at end 59 of channel 50 to form a locked position, thereby locking the saw blade and mode selection pin 60 in position, in this locked position, arbour bolt 82 it adjacent window 20 of outer guard portion 16 to allow changing of the saw blade 8. The blade, tool body and mode selection pin 60 cannot be moved until lock release button 70 is actuated to move the locking pin from a locked position to an unlocked position. In addition, the user actuatable "on"/"off" switch is in an interlocked position (i.e. cannot be operated) until the lock release button is actuated, in the other operational modes, the arbour bolt is not accessible through window 20, thereby preventing removal of the blade unless the tool o m the correct blade changing mode.

FIGS. 7*a*-7*b* illustrate a track compensation mechanism for use with the tool when the tool is not being used on a track. Circular plunge saws can be used on a track to maintain alignment of the saw in use or can be used directly on a workpiece. When the saw is placed on a track, the available cutting depth of the saw blade into a workpiece is reduced by the thickness of the track. For example, the saw is raised a pre-determined distance above the workplace when placed on the track, which in turn is placed on a top surface of a workpiece. Distance measurement ruler 28 on a conventional tool does not take the difference the track thickness makes to the measured depth of cut into account. As such, when a user measures a depth of cut on a conventional distance measurement ruler, it can be up to 5 mm out of position. However, the track compensation mechanism of the present invention docs take the depth of a standard track the tool would normally be used on into consideration. A locking nut 86 is provided, which has a required depth of cut pointer 88 associated with the same, for allowing a east to set a required depth of cut with respect to distance measurement ruler 28. A top surface of the depth of cut pointer 88 acts as a stop surface 89 lot a stop rib 90 associated with the tool body 4. In normal operation of tool 2 on a track, as the tool, body 4 is pivotally moved towards base plate 6 in the plunge cut mode, the stop rib 90 on the tool body 4 engages against stop surface 89 on pointer 88, thereby preventing further travel cot tool body 4 towards base plate 6. The length of saw blade protruding through the working aperture 18 of guard 12 corresponds to the selected depth of cut shown by pointer 88 on measurement ruler 28.

In accordance with the invention, if the toot 2 is not used on a track, a stop protrusion 91 is pivotably movable with respect to stop surface 89 of pointer 88 from a retracted position, wherein it is retracted in a slot defined in stop surface 89, through 180 degrees to an extended position, where it protrudes upwardly from pointer 88 towards tool body 4. The stop protrusion 91 is of a pre-determined height corresponding to the thickness of the track, as shown in FIG. 7*b*. As such, as the tool body 4 is pivotally moved towards base plate 6 in the plunge cut mode, the stop rib 90 engages against stop protrusion 91 in the extended position. Thus, the required depth of cut provided by the saw blade is as set by pointer 88 on the measurement ruler rather than being an incorrect amount as with conventional tools. The method of the present invention does not rely on a user having to calculate the depth of track and taking this into account when setting the required depth of cut on the measurement ruler.

FIGS. 8*a*-8*d* show a fine adjustment mechanism 102 tor use on the base plate 6 of a tool 2 when placed on a track 100 in one embodiment of the present invention. The fine adjustment mechanism 102 allows the base plate 6 of the tool to be moved into increased contact with track 100 to prevent any unnecessary movement of the tool with respect to the track and to align the plunge saw correctly cm the track.

Figure 8C:
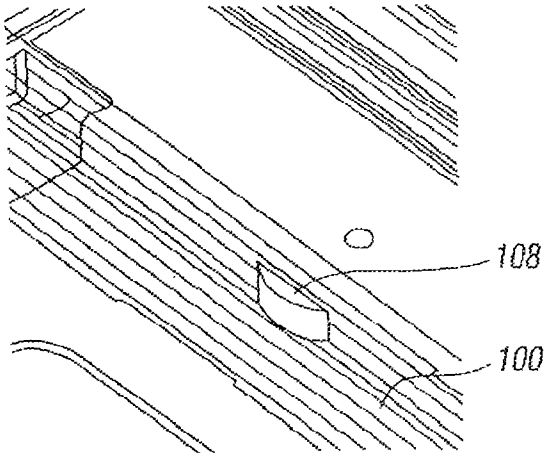
Figure 8D:
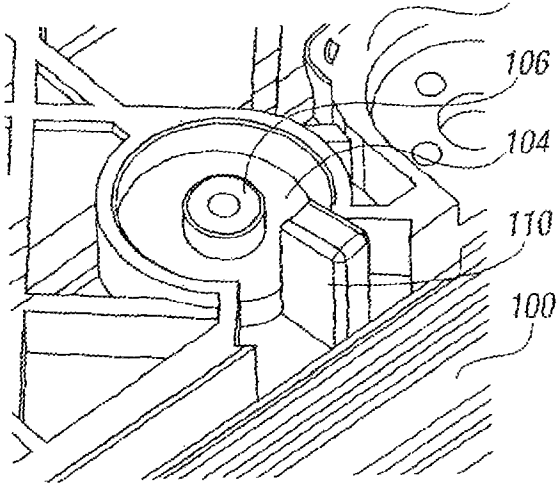
Figure 8A:
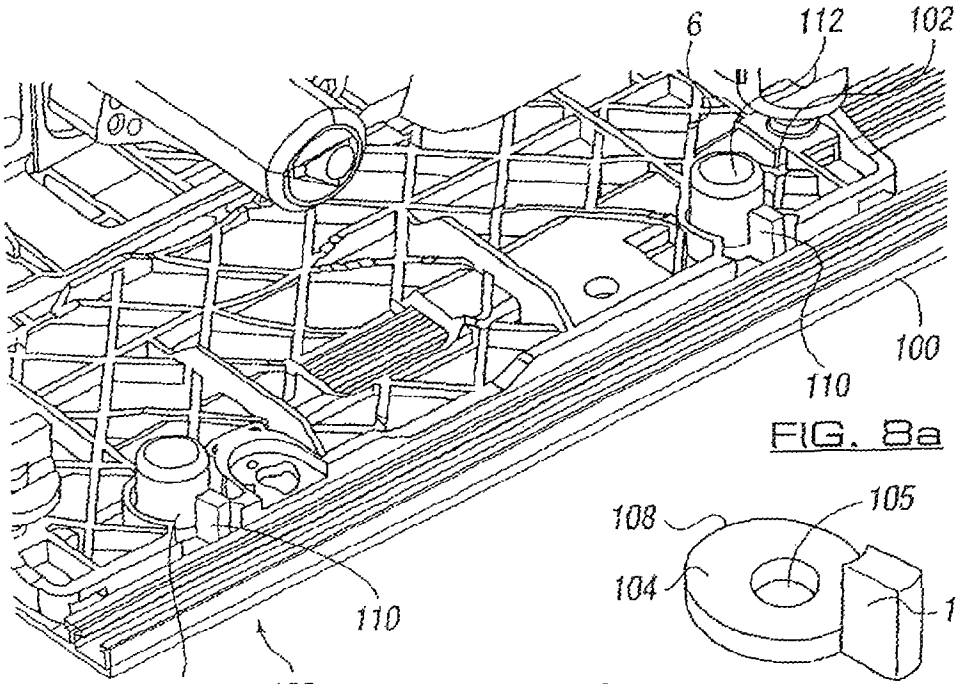
Figure 8B:
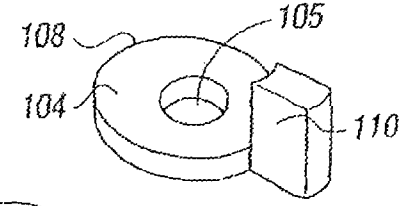
Figure 8B:
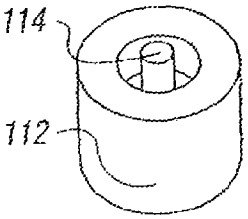

The fine adjustment mechanism 102 includes a lever 104 having an aperture 105 that is rotatably mounted over a sleeve member 106 protruding upwardly from base plate 6. An outer side wall of lever 104 is provided with a cam surface 108. This cam surface 108 is arranged to protrude through an aperture defined in a profiled portion of base plate 6 such that it can engage with an upwardly protruding portion of track 100, as shown in FIG. 8*c*. Rotation of lever 104 using user actuation portion 110 causes said cam surface 108 to move into and out of engagement with track 100 as required. A top member 112 sits on trap of lever 104 and provides a locking means for locking lever 104 in position. The top member 112 is typically in the form of a locking knob with a threaded portion. A pin 114 is aligned with and engages in sleeve 106 to fix the top member 112 to lever 104 and base plate 6.

In a preferred embodiment two fine adjustment mechanisms are provided, one at the front of the base plate and one at the rear of the base plate.

FIGS. 9*a*-9*c* illustrate a track lock 116 in one embodiment of the present invention for locking the base plate 6 of the tool 2 to the track 100 when the tool is being used to make a bevel cut. The track lock 116 includes a locking lever 118 having an upwardly protruding sleeve member 120 provided thereon for location through an aperture 122 defined in base plate 6. The locking lever 118 has a cam surface 124 that engages in a channel 126 defined on the track 100. A rotatable user actuation knob 128 engages with sleeve member 120, such that rotation of knob 128 causes cam surface 124 to move info and tint of engagement with track 100. The knob 128 can be resiliently biased to a locked position by a spring.

FIGS. 10*a*-10*d* illustrate an anti-kick back mechanism 130 in one embodiment of the present invention to ensure the tool body only moves in one direction when the base plate is engaged on a track in use.

The mechanism 130 includes a lower lever portion 132 that is rotatably mounted on base plate 6 via a sleeve portion 134 that protrudes upwardly through an aperture defined in base plate 6. The base 136 of lower lover portion 132 is substantially flush with base plate 6. A plurality of teeth 138 are provided on a side wall 140 adjacent base 136 and protrude through an aperture 142 defined in a profiled portion of base 136 so as to engage with a side of track 100 in use. The teeth allow travel of the lever portion 132 against the track 100 in a first direction only in use. A spring 144 is provided to bias lower lever portion 132 back to an engaged position (i.e. where the teeth protrude through aperture 142 so as to engage with a track in use) front a disengaged position (i.e. where the teeth are rotated out of engagement with the track against the biasing force of spring 144). A rotatable knob 146 engages with sleeve portion 134 to allow a user to rotate knob to move the teeth 138 to a disengaged position to allow the tool, to be located on the track in use.

Figure 10C:
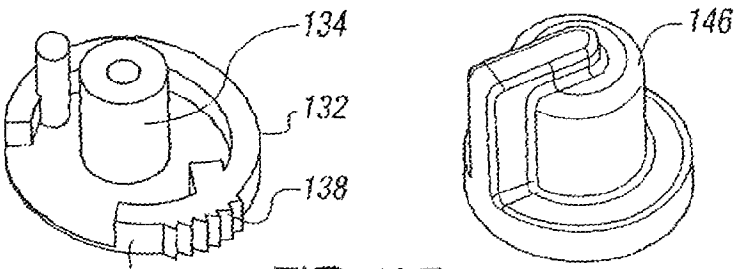
Figure 10D:
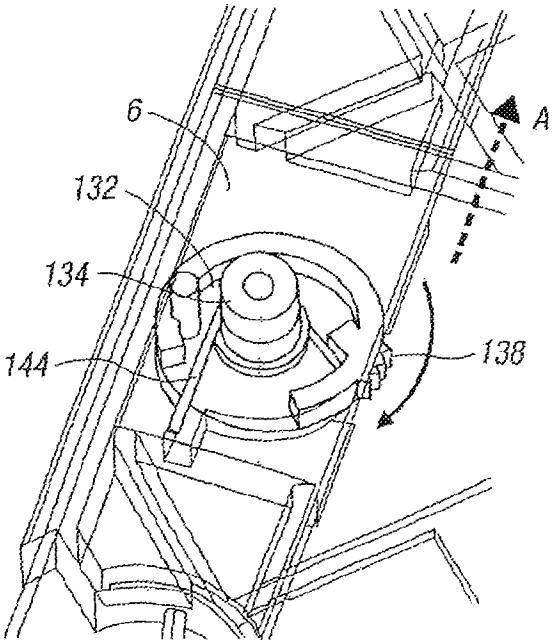
Figure 10B:
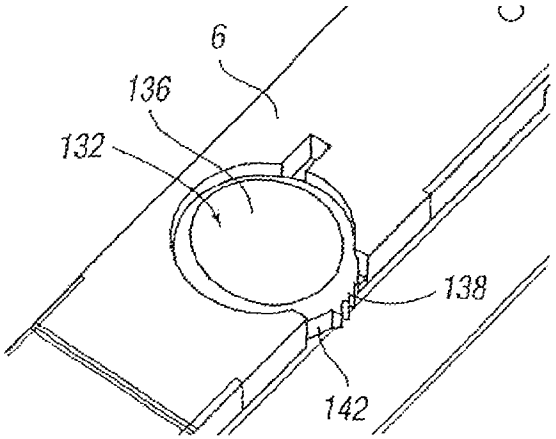
Figure 10A:
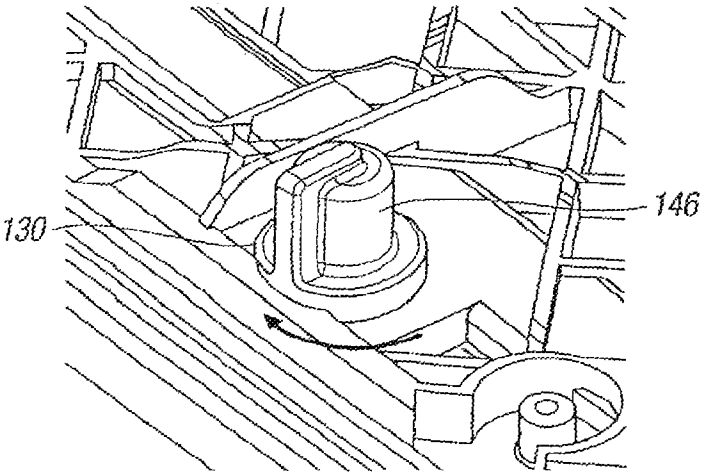

Thus, when the tool is moving in direction A along the track, as shown in FIG. 10*d*, any kickback from the fool during the cutting process is prevented as a result of teeth 138 engaging the track and preventing movement of the tool in the opposite direction to A.

It will be appreciated by persons skilled in the art that any or any combination of the mechanisms shown in 7*a*-10*d* could be used on any circular saw and are nor limited to being provided on a circular saw containing the selection mode features described above.

The invention claimed is:

1. A powered circular saw tool, said tool including a tool body, attachment means for allowing a circular saw blade to be attached to the tool body in use, and a base plate associated with the tool body for supporting the tool body on a workpiece or surface in use, said tool body arranged such that it is capable of undergoing pivotal movement relative to said base plate to allow the circular saw blade to be pivoted, to a required depth of cut with respect to a workpiece in use, said tool including two or more different operational modes including a saw blade changing mode and a plunge mode and/or a scribe mode that can he selected by a user in use, single selection means is provided to allow selection of the different operational modes, the single mode selection means used is the same for each different operational mode and wherein said mode selection means includes a selection pin and a locking pin, and the movement of said selection pin and locking pin allows the selection of the operational modes: and wherein:

the locking pin is provided a spaced distance apart from said selection pin on said tool, the tool provided with one or more arcs and joining portions, the locking pin movable in the one or more arcs and/or joining portions associated with the mode selection means, and the locking pin substantially follows movement of the selection pin in use.

2. A powered circular saw tool, said tool including a tool body, attachment means for allowing a circular saw blade to be attached to the tool body in use, and a base plate associated with the tool body for supporting the tool body on a workpiece or surface in use, said tool body arranged such that it is capable of undergoing pivotal movement relative to said base plate to allow the circular saw blade to be pivoted to a required depth of cut with respect to a workpiecc in use, said tool including two or more different operational modes including a saw blade changing mode and a plunge mode and/or a scribe mode that can be selected by a user in use, single selection means is provided, to allow selection of the different operational modes, the single mode selection means used is the same for each different operational mode and wherein said single mode selection means includes a selection pin for allowing selection of the different operational modes of the tool and a locking pin for locking the tool in a particular selected operational mode, the hocking pin arranged to substantially follow the movement of the selection pin in use to allow the selection of the operational modes.

3. A tool according to claim 2 wherein guide means in the form of at least one slot, recess, channel and/or aperture are provided on the tool to guide the movement of the tool body relative to the base plate in each of the different operational modes, and at least part of the mode selection means is movable with respect to the guide means in moving the tool body between the different operational modes.

4. A tool according to claim 3 wherein the slot, recess, channel and/or aperture of the guide means is in the shape of at least one arc.

5. A tool according to claim 4 wherein the at least one arc comprises two or more arcs, each are corresponding to each of two or more different operational modes of the tool, or the at least one arc comprises at least three arcs, each arc corresponding to each of three different operational modes of the tool, or the at least one arc comprises four arcs that correspond to three different operational modes of the tool.

6. A tool according, to claim 4 wherein the at least one arc comprises two or more arcs arc provided and the arcs have one or more of the following features: the arcs are arranged substantially concentrically, with each arc having a different radius from a central point to provide the arcs in a spaced apart arrangement; the length of each are is substantially different; the arc corresponding to the plunge mode operational, position of the tool is longer in the length relative to the arc corresponding to the scribe, mode of the tool; said two or more arcs are spaced distance apart from each other, adjacent arcs communicating via at least one joining portion; and the arc corresponding to the blade changing mode of the tool is the outermost arc relative to the tool base plate.

7. A tool according to claim 2 wherein the locking pin is provided a spaced distance apart from said selection pin on said tool, said tool includes one or more arcs and/or joining portions associated with said operational modes, the locking pin movable in the one or more arcs and/or joining portions associated with the mode selection means.

8. A tool according to claim 1 wherein the tool includes arcs and/or joining portions, the arcs and/or joining portions are in the form of channels or recesses and the depths of the channels or recesses in one or more parts of the arcs and/or joining portions are different to allow location of the locking pin therein to form a locked position.

9. A tool according to claim 2 wherein said tool includes tool mode selection arcs associated with said operational modes a guard slot, channel, recess or aperture is defined in at least a portion of a guard provided for the saw blade and arranged substantially concentrically with respect to said tool mode selection arcs.

10. A tool according to claim 2 wherein the tool is provided with a guard for the saw blade, said guard including an inner guard portion and an outer guard portion, the saw blade being located between the inner and outer guard portions in use, the tool provided with guide means, one of the guide means and the mode selection means is provided on the inner guard portion and the other of the guide means and the mode selection means is provided on or associated with the tool body.

11. A tool according to claim 2 wherein at least part of the attachment means for the saw blade is slidably mounted in a slot, channel, recess or aperture defined in at least a portion of a guard provided for the saw blade in use.

12. A tool according to claim 2 wherein the selection pin is integral with or attached to a rotatable member or cylinder, rotation of the rotatable member or cylinder causing rotational movement of the selection pin or movement of the selection pin through at least a partially circular path in use, and the locking pin is associated with the rotatable member or cylinder, such that movement of the rotatable member or cylinder and the selection pin causes corresponding movement of the locking pin.

13. A tool according to claim 2 wherein the tool includes a rotatable cylinder or member and the locking pin and the selection pin are arranged substantially concentrically of the rotatable cylinder or member, with the locking pin having a different radius to that of the selection pin.

14. A tool according to claim 2 wherein the tool has a rotatable cylinder or member and user actuation means are associated with the locking pin to allow a user to move the locking pin to an unlocked position in use, and/or the user actuation means are associated with the rotatable cylinder or member or the mode selection means to allow a user to select one of the two or more different operational modes of the tool.

15. A method of using a powered circular saw tool, said tool including a tool body, attachment means for allowing a circular saw blade to be attached to the tool body in use, and a base plate associated with the tool body for supporting the tool body on a workpiece or surface in use, said tool body arranged such that it is capable of undergoing pivotal movement relative to said base plate to allow the circular saw blade to be pivoted to a required depth of cut with respect to a workpiece in use, said method including the step of selecting an operational mode for the tool from two or more different selectable tool operational modes including a saw blade changing mode and a plunge mode and/or scribe mode, and a means for allowing the selection of the different operational modes is the same for each different operational mode, and wherein operation of the selection means causes a selection pin and a locking pin to move to a position to allow the operational mode to be selected and maintained.

* * * * *